US008915566B2

(12) United States Patent
Morita et al.

(10) Patent No.: US 8,915,566 B2
(45) Date of Patent: Dec. 23, 2014

(54) IMAGE FORMING APPARATUS

(75) Inventors: Yoshihisa Morita, Tokyo (JP); Tomohiko Shimoda, Tokyo (JP); Hitoshi Arai, Tokyo (JP)

(73) Assignee: Riso Kagaku Corporation, Minato-Ku, Tokyo (JP)

( * ) Notice: Subject to any disclaimer, the term of this patent is extended or adjusted under 35 U.S.C. 154(b) by 240 days.

(21) Appl. No.: 13/415,385

(22) Filed: Mar. 8, 2012

(65) Prior Publication Data

US 2012/0249649 A1 Oct. 4, 2012

(30) Foreign Application Priority Data

Mar. 29, 2011 (JP) ..... 2011-072674

(51) Int. Cl.
*B41J 29/38* (2006.01)
*B41J 13/00* (2006.01)
*B41J 11/00* (2006.01)

(52) U.S. Cl.
CPC ..... *B41J 13/0036* (2013.01); *B41J 11/009* (2013.01)
USPC ..... 347/16

(58) Field of Classification Search
CPC ..... B41J 13/0036; B41J 11/009
USPC ..... 347/16, 104, 19; 271/288, 292, 293, 271/202
See application file for complete search history.

(56) References Cited

U.S. PATENT DOCUMENTS

| | | | | |
|---|---|---|---|---|
| 5,412,462 | A * | 5/1995 | Matsuo et al. | 399/367 |
| 7,661,670 | B2 | 2/2010 | Shinohara | |
| 7,950,652 | B2 * | 5/2011 | Terao et al. | 271/220 |
| 2009/0212497 | A1 * | 8/2009 | Kawaguchi et al. | 271/308 |

FOREIGN PATENT DOCUMENTS

| | | | |
|---|---|---|---|
| JP | 2005-195650 | A | 7/2005 |
| JP | 2007-156229 | A | 6/2007 |
| JP | 2008-195459 | A | 8/2008 |
| JP | 2010-143728 | | 7/2010 |

OTHER PUBLICATIONS

Japan Patent Office, "Office Action for JP 2011-072674," Sep. 9, 2014.

* cited by examiner

*Primary Examiner* — Julian Huffman
(74) *Attorney, Agent, or Firm* — Manabu Kanesaka

(57) ABSTRACT

An image forming apparatus includes a conveying device for conveying paper, an image forming unit for forming an image on the paper, and a paper discharge tray where the image-formed paper is discharged and loaded at a predetermined discharge angle by the conveying device. The conveying device is controlled in a manner that a discharge speed of a first sheet of the paper is different from a discharge speed of second and subsequent sheets of the paper.

14 Claims, 5 Drawing Sheets

IMAGE FORMING APPARATUS

RELATED APPLICATIONS

The present application is based on, and claims priority from, Japanese Application No. JP2011-072674 filed Mar. 29, 2011, the disclosure of which is hereby incorporated by reference herein in its entirety.

TECHNICAL FIELD

The present invention relates to an image forming apparatus that discharges and loads image-formed paper onto a paper discharge tray, and more specifically to an image forming apparatus capable of orderly aligning and loading even thin paper with weak rigidity in particular onto the paper discharge tray without causing deteriorated discharged paper alignment, paper discharge failure, etc.

BACKGROUND ART

In a paper discharge mechanism of an image forming apparatus, especially when print paper such as thin paper with weak rigidity is discharged at time of high-speed printing, deformation such as rising of a tip end part of the paper across its full width or upward and rounded turning of both corner parts of the tip end of the paper may occur due to air resistance. Because of such deformation, the paper may lose its speed and drop so as to cover a discharge port, thereby causing problems specific to the thin paper, including paper discharge failure such as jam and deteriorated discharged paper alignment. Such problems occur remarkably on the first sheet of a print in particular.

Disclosed in Patent Literature 1 below is an invention of a paper discharge device intended to solve a problem that a tip end of paper such as thin paper with weak rigidity is caught by a paper discharge tray surface and a tip end part is thereby rounded. In this paper discharge device, the relationship between first and second nips N1 and N2 and the gently sloped surface 4b is set in order that paper discharge angles θa and θe formed by paper P discharged from the first nip N1 and the second nip N2 and a gently sloped surface 4b as a paper loading surface become favorable angles that do not cause paper rounding as a result of catching of the tip end of the paper P by the gently sloped surface 4b. Therefore, the paper discharge from the first nip N1 continues until reaching predetermined height Y1 that can maintain the favorable paper angles, and then upon switching of a paper discharge path to the higher-class second nip N2, the paper discharge from the second nip N2 starts at a favorable paper discharge angle for the topmost paper discharged from the first nip N1, which permits smooth discharge and loading of the paper up to height Y2 as a loading limit.

SUMMARY OF INVENTION

Technical Problem

The invention of the paper discharge device disclosed in Patent Literature 1 maintains a predetermined angle formed by the discharged paper and the paper discharge tray by switching a discharge mechanism in accordance with the number of discharged paper sheets and thereby performs stable discharge but faces a problem of upsizing the device. Moreover, the invention does not consider behavior of the first sheet of a print and does not at all solve the problems (for example, the paper discharge failure and the deteriorated discharged paper alignment attributable to the rising of the tip end part across its full width or the rounding of the both corner parts of the tip end part) remarkably occurring on the first sheet of the print in particular.

In view of such conventional problems, the present invention has been made, and it is an object of the invention to perform orderly alignment and loading of even thin paper with weak rigidity on a paper discharge tray starting with the first sheet of a print without causing deteriorated discharged paper alignment, paper discharge failure, etc.

Solution to Problem

An image forming apparatus according to claim 1 is characterized by including: conveying means for paper; an image forming means for forming an image on the paper; and a paper discharge tray where the image-formed paper is discharged and loaded at a predetermined discharge angle by the conveying means, wherein a speed of the paper discharge by the conveying means is controlled in accordance with at least one of the discharge angle and a kind of paper to be used.

In the image forming apparatus according to claim 1, the image forming apparatus according to claim 2 is characterized in that the conveying means is controlled in a manner that a discharge speed of a first sheet of the paper becomes faster than a discharge speed of second and subsequent sheets of the paper with an increase in the discharge angle and/or a decrease in a paper thickness for the paper kind.

In the image forming apparatus according to claim 2, the image forming apparatus according to claim 3 is characterized by further including: a plurality of kinds of the paper discharge trays with different discharge angles; storage means for storing, for each of the paper discharge trays, correspondence between a combination of the discharge angle and the paper thickness and the discharge speed of the paper; paper specifying means for specifying the paper to be used; paper discharge tray specifying means for specifying the paper discharge tray to be used; and control means for controlling the conveying means by reading, from the storage means, the discharge speed corresponding to the combination of the paper specified by the paper specifying means and the paper discharge tray specified by the paper discharge tray specifying means.

In the image forming apparatus according to claim any one of claims 1 to 3, the image forming apparatus according to claim 4 is characterized in that the paper discharge tray includes on both sides thereof a pair of stiffening members respectively making contact with both edge parts of the discharged paper in a width direction and stiffening the paper, the stiffening members being capable of adjusting a space, and in order to control paper stiffness by the stiffening members in accordance with at least one of the discharge angle and the kind of the paper to be used, the space between the pair of stiffening members when the first sheet of the paper makes contact is narrowed more than that in a case where the second and subsequent sheets of the paper make contact with an increase in the discharge angle and a decrease in a paper thickness for the paper kind.

Advantageous Effects of Invention

With the image forming apparatus according to claim 1, the conveying means is controlled in accordance with at least one of the discharge angle and the kind of the paper to be used upon the paper discharge to the paper discharge tray to thereby adjust the discharge speed upon the paper discharge to the paper discharge tray. Thus, with even thin paper with weak rigidity or even in a case where resistance received from air by the discharged paper is increased by the discharge angle, the paper is discharged onto the paper discharge tray at the appropriately controlled discharge speed; therefore, for example, paper deformation such as rising of a tip end part hardly occurs, and thus paper discharge failure, deteriorated discharged paper alignment, etc. attributable to this hardly occur.

With the image forming apparatus according to claim 2, the discharge speed of the first sheet of the paper is faster than that of the second and subsequent sheets of the paper with an increase in the discharge angle measured with the paper oriented upwardly from the horizontal direction and with a decrease in the paper thickness, which therefore permits orderly alignment and loading onto the paper discharge tray starting with the first sheet of a print in particular.

With the image forming apparatus according to claim 3, specifying the kind of the paper to be used by the paper specifying means and specifying the paper discharge tray by the paper discharge tray specifying means permit the control means to read, from the storage means, the appropriate paper discharge speed corresponding to the above specification and discharge the first sheet of the paper at this discharge speed and also discharge the second and subsequent sheets of the paper at a slower speed. Therefore, for various combinations of a plurality of paper kinds and a plurality of paper discharge trays, a precise operation of performing orderly alignment and loading starting with the first sheet of the print can easily be performed by anyone without relying on experience.

With the image forming apparatus according to claim 4, in addition to the aforementioned control of the paper discharge speed above in correspondence with at least one of the paper discharge angle and the paper kind, with a further increase in the discharge angle and with a decrease in the paper thickness, the space between the stiffening members when contacted by the first sheet of the paper is narrowed more than the space when contacted by the second and subsequent sheets of the paper. Thus, in the discharge of especially the first sheet of the paper more susceptible to the air resistance, for example, the deformation such as the rising of the tip end part even more hardly occurs, which can suppress even more reliably the paper discharge failure, the deteriorated discharged paper alignment, etc. attributable to this.

DESCRIPTION OF EMBODIMENT

An image forming apparatus 1 according to an embodiment of the present invention will be described with reference to FIGS. 1 to 6. This image forming apparatus 1 is an apparatus that forms an image on paper and discharges the paper, and is characterized by, especially when thin paper with weak rigidity is used, controlling paper discharge speed, etc. in accordance with a discharge angle and a kind of the paper in order to eliminate risks of deteriorated discharged paper alignment, paper discharge failure, etc. as a result of occurrence of deformation of a tip end at a first discharged page of the paper in particular.

For the first discharged paper, the thin paper on which the deteriorated discharged paper alignment, the paper discharge failure, etc. possibly occur is, for example, paper having a basis weight of 52 $g/m^2$ or less and, for example, paper having a pure bending rigidity of 75 $\mu N \cdot m^2/m$.

First, a basic structure, etc. of the image forming apparatus 1 will be described with reference to FIGS. 1 to 3.

Figure 1:
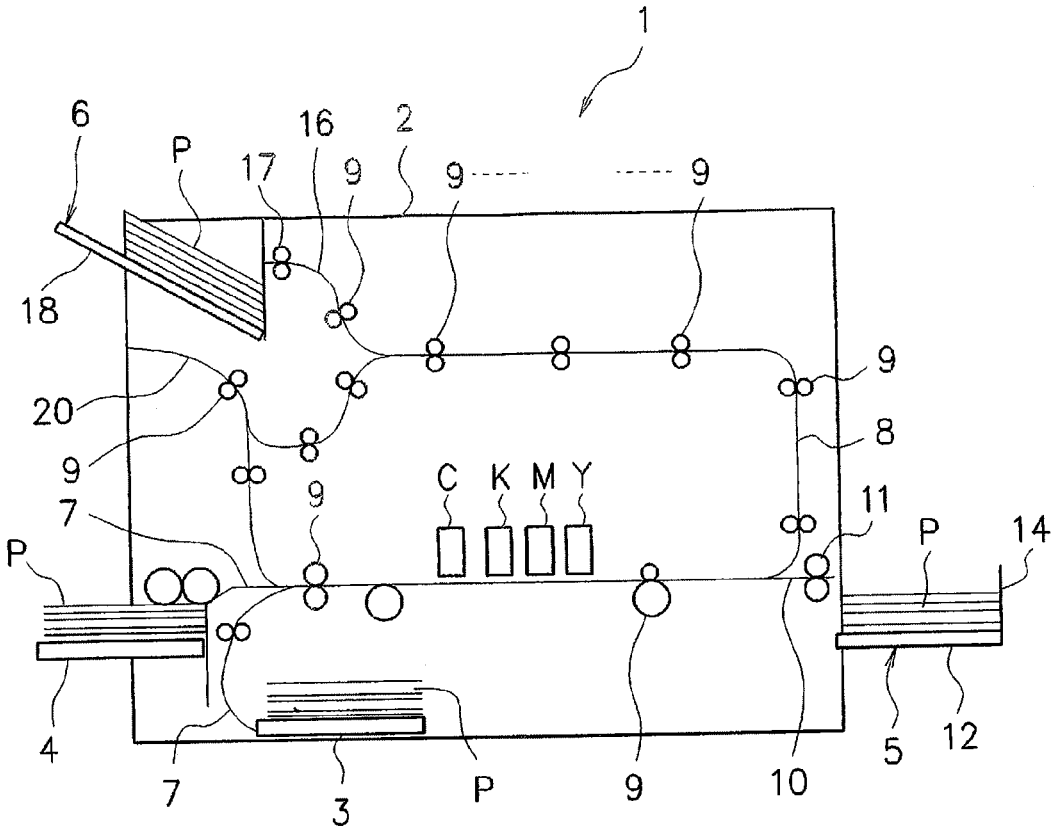
FIG. 1 is a schematic sectional view showing overall configuration of an image forming apparatus according to an embodiment of the present invention.

As shown in FIG. 1, this image forming apparatus 1 includes two paper feed trays 3 and 4 inside and on a side of a casing 2 storing various parts of the apparatus. On these paper feed trays 3 and 4, paper sheets P of different kinds are respectively stored, and can be selectively used in accordance with preference of the user.

The paper kinds here mean regular paper sizes (dimensions) such as A3, A4, B4, and B5, or paper materials such as thin paper, plain paper, and a cardboard. Note that the image forming apparatus 1 is in particular characterized by controlling a paper speed upon paper discharge to paper discharge trays 5 and 6, and one of indices for performing this control is the paper kind. Here, the paper kind as the control index is a property indicating easiness of deformation when the discharged paper meets resistance from air, and indicates, for example, "pure bending hardness" (in $\mu N \cdot m^2/m$) corresponding to strength or weakness of paper rigidity or "basis weight" (in $g/m^2$).

As shown in FIG. 1, the paper P exiting from the paper feed trays 3 and 4 is delivered from an introduction port 7 to a loop-like conveying path 8 and conveyed by a plurality of conveying means 9 arranged along the conveying path 8. Arranged at a lower half part of the conveying path 8 is print means provided along the conveying path 8. The print means is composed of four inkjet heads C, K, M, and Y respectively discharging inks of different colors of cyan, black, magenta, and yellow. These inkjet heads C, K, M, and Y are arranged downwardly along the conveying path 8 at predetermined intervals, and form an image on a top surface of the paper P conveyed through the conveying path 8 by the conveying means 9.

As shown in FIG. 1, at this loop-like conveying path 8, a first discharge path 10 is provided at an adjacent part downstream of the print means in a diverging manner. The first discharge path 10 is a path for horizontally guiding the image-formed paper and discharging it to outside of the apparatus, and includes at its end part discharge rollers 11 as the conveying means 9. The discharge rollers 11 face a discharge port (not shown) provided at the casing 2, and below this discharge port, a face-up paper discharge tray 5 is fitted to an outside surface of the casing 2. The face-up means a paper discharge tray performing discharge with the image-formed surface facing upward immediately before the discharge from the image forming apparatus. The paper P discharged from the first discharge path 10 to the outside of the casing 2 by the discharge rollers 11 is delivered to the face-up paper discharge tray 5 and then loaded with the image facing upward.

Figure 2A:
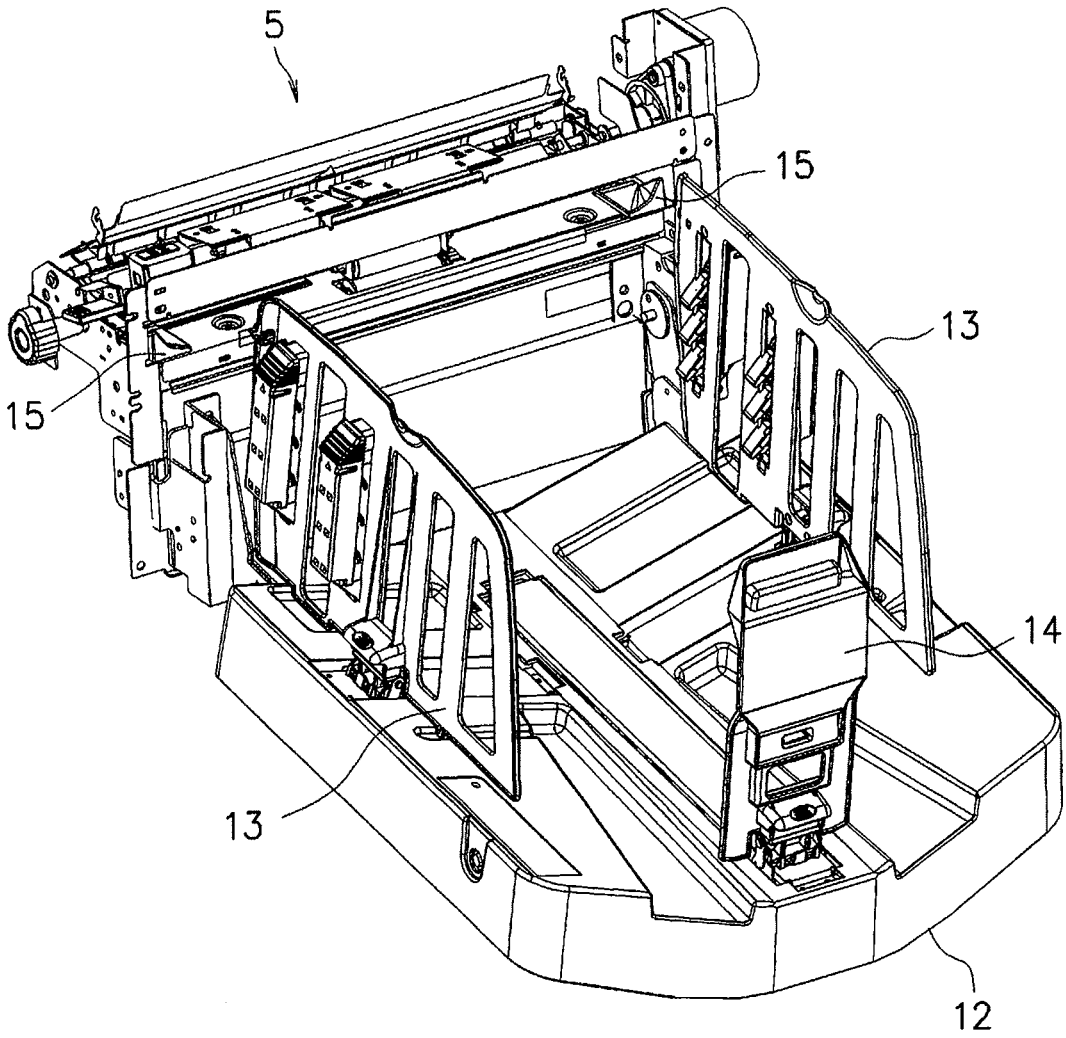
FIG. 2A is a perspective view of a face-up paper discharge tray in the image forming apparatus of this embodiment.

FIG. 2A is a perspective view of a first discharge unit. The first discharge unit is a component unit composed of: a driving mechanism including the discharge rollers 11 arranged in the casing 2; and the face-up paper discharge tray 5 arranged on the outside surface of the casing 2, and this figure shows a detailed structure of this unit. The face-up paper discharge tray 5 is a paper discharge tray where the paper P is discharged in a posture in which a printed image faces upwardly immediately before discharged from the image forming apparatus. The face-up paper discharge tray 5 has: a base 12 whose section at a section line orthogonal to a discharge direction of the paper P is substantially V-shaped; a pair of side plates 13 and 13 provided at both side parts of the base 12 in a width direction orthogonal to the discharge direction of the paper P; and a striking plate 14 provided at a downstream end part of the base 12 in the discharge direction. The positions of the side plates 13 and the striking plate 14 can be adjusted as appropriate in accordance with a dimension of the paper P, etc.

As shown in FIG. 2A, provided at an entrance side of the face-up paper discharge tray 5, that is, downstream of the discharge rollers 11 now shown in the same figure is a pair of stiffening members 15 (referred to as wings) that respectively make contact with both edge parts of the discharged paper P in the width direction and stiffen the paper P in a shape protruding downwardly, that is, a downstream side of the discharge rollers 11 not shown in the same figure. As schematically shown on an enlarged scale in FIG. 2B, each stiffening member 15 is a member whose section in the width direction of the paper P has a shape of a rectangular triangle, and the stiffening members 15 and 15 are arranged symmetrically with respect to a center line of the paper P in a conveyance direction in a state in which their oblique sides are facing upwardly and inwardly. Passage of the paper P through a space between the pair of stiffening members 15 and 15 arranged in this manner brings about a state in which both side edges of the paper P in the width direction are curved upwardly across its full length in the conveyance direction, and the paper P is discharged so as to be convexed downwardly.

Figure 2B:
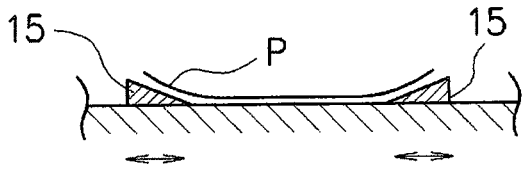
FIG. 2B is a sectional view showing a structure of a pair of stiffening members in the same paper discharge tray.

As shown by arrows in FIG. 2B, the pair of stiffening members 15 and 15 is adapted to be movable by an interlocking mechanism (not shown) symmetrically and oppositely to each other with respect to the center line. Moreover, the pair of stiffening members 15 and 15 can adjust any space in accordance with a width and a kind of the paper P with wing moving means as a manual driving mechanism (not shown), and thereby can appropriately set a degree of warping to stiffen the paper P in required strength at time of discharge.

For example, in a case where the kind of the paper P is thin paper and inconvenience is assumed to occur due to weak rigidity, the space between the pair of stiffening members 15 and 15 is set shorter than that in normal setting to increase the degree of warping of the paper P. That is, as a result of the passage through the pair of stiffening members 15 and 15, the paper P is discharged while curved with great curvature in the width direction across its full length in the conveyance direction of the paper P. Consequently, even the thin paper P with weak rigidity and even the first sheet of a print having no air flow and being susceptible to air resistance are delivered onto the paper discharge tray without deformation and drop at a predetermined position; therefore, the inconvenience described above can be avoided, which permits orderly loading on the paper discharge tray.

As shown in FIG. 1, at an upper half part of the loop-like conveyance path 8, a second discharge path 16 that discharges the paper P to outside of the loop is provided in a diverging manner. The second discharge path 16 is a path for guiding the image-formed paper P to the outside of the loop and discharging the paper P obliquely and upwardly to the outside of the casing 2, and includes at its end part discharge rollers 17 as the conveying means 9. The discharge rollers 17 face a discharge port (not shown) provided at the casing 2, and below this discharge port, a face-down paper discharge tray 6 as a second paper discharge tray is fitted to an outside surface of the casing 2. The face-down means a paper discharge tray that performs the discharge with the image-formed surface facing downward immediately before the discharge from the image forming apparatus. The paper P discharged from the second discharge path 16 to the outside of the casing 2 by the discharge rollers 17 is delivered to the face-down paper discharge tray 6 and loaded with the printed image facing downward immediately before being discharged from the image forming apparatus.

Figure 3A:
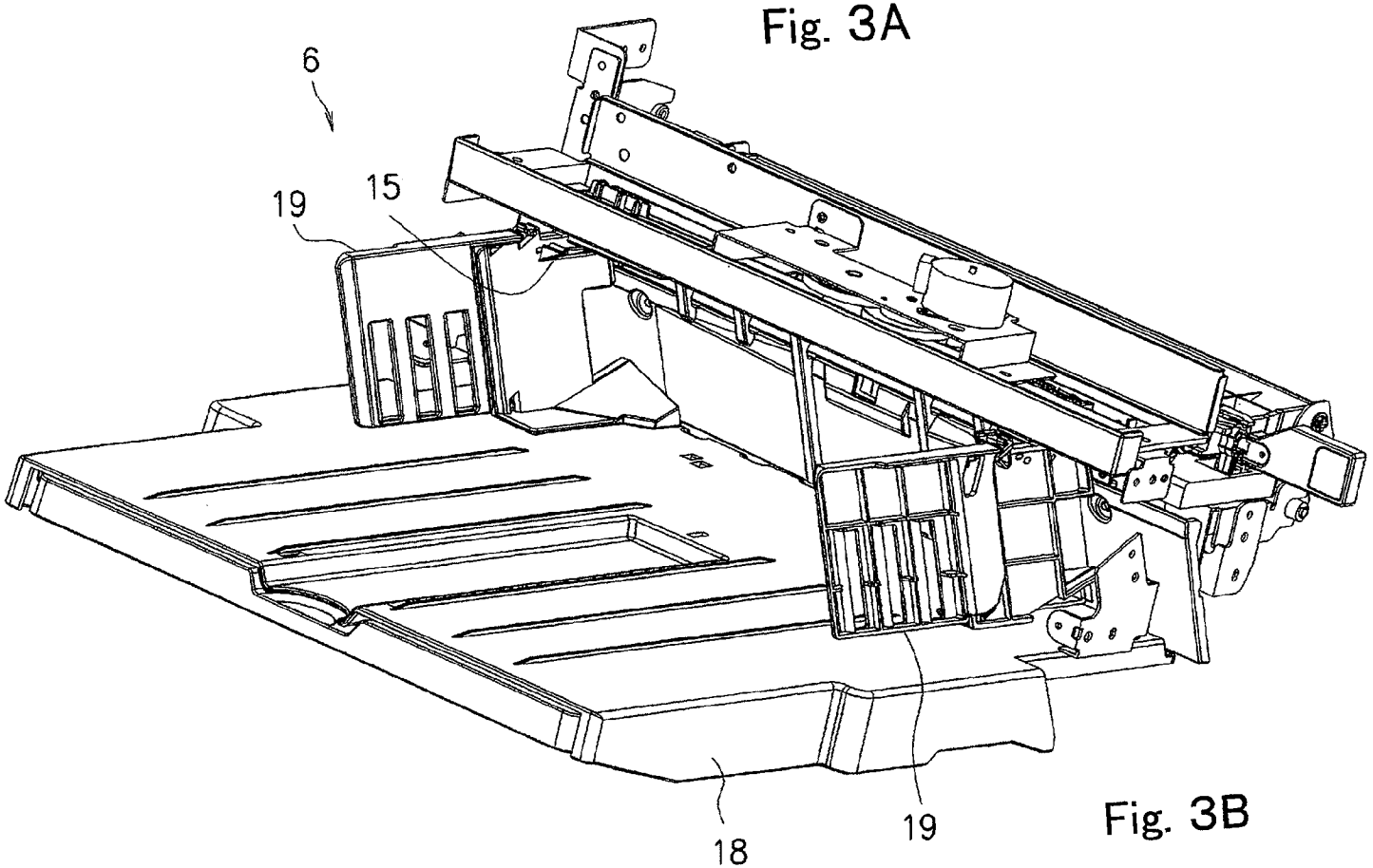
FIG. 3A is a perspective view of a face-down paper discharge tray in the image forming apparatus of this embodiment.

FIG. 3A is a perspective view of a second discharge unit. The second discharge unit is a component unit composed of a driving mechanism including the discharge rollers 17 arranged in the casing and the face-down paper discharge tray 6 arranged on the outside surface of the casing 2, showing a detailed structure of this unit. The face-down paper discharge tray 6 is a paper discharge tray where the paper P is discharged in a posture in which the printed image is oriented downwardly. The face-down paper discharge tray 6 has: a base 18 of a flat-plate-like shape where the paper P is loaded; and a pair of side plates 19 and 19 provided at both side parts of the base 18 in the width direction of the paper P. The side plate 19 can make position adjustment as appropriate in accordance with the dimension of the paper P, etc. In FIG. 3A, the base 18 of the face-down paper discharge tray 6 is shown horizontally, but in a state in which it is actually fitted to the image forming apparatus 1, the base 18 is oriented upwardly by a predetermined angle from the horizontal direction as shown in FIG. 1. Therefore, the paper P discharged obliquely and upwardly with the discharge rollers 17 once moves up, then drops by force of gravity, and is sequentially loaded onto the base 18.

As shown in FIG. 3A, provided on an entrance side of the face-down paper discharge tray 6, that is, on a downstream side of the discharge rollers 17 not shown in the same figure is a pair of stiffening members 15 and 15 (referred to as wings) that respectively make contact with the both edge parts of the discharged paper P in the width direction and stiffen the paper P in a form protruding upwardly. As schematically shown on an enlarged scale in FIG. 3B, each stiffening member 15 is a member whose section in the width direction of the paper P has a shape of a rectangular triangle, and the stiffening members 15 and 15 are arranged symmetrically with respect to the center line of the paper P in the conveyance direction in a state in which their oblique sides are oriented downwardly and inwardly. Passage of the paper P through the space between the pair of stiffening members 15 and 15 arranged in this manner brings about a state in which the both side edges of the paper P in the width direction are curved downwardly across its full length in the conveyance direction, and the paper P is discharged so as to be convexed upwardly.

Figure 3B:
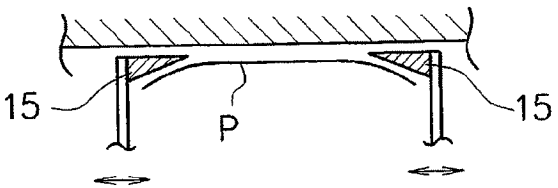
FIG. 3B is a sectional view showing a structure of a pair of stiffening members in the same paper discharge tray.

As shown by arrows in FIG. 3B, the pair of stiffening members 15 and 15 is adapted to be movable by an interlocking mechanism (not shown) oppositely and symmetrically to each other with respect to the center line. Moreover, the pair of stiffening members 15 and 15 can adjust any space in accordance with the width and the kind of the paper P with wing moving means as a manual driving mechanism (not shown), and can thereby appropriately set the degree of warping to stiffen the paper P in required strength at time of discharge.

An action of the stiffening member 15 in the face-down paper discharge tray 6 is the same as that of the stiffening member 15 of the face-up paper discharge tray 5 in principle, but if other conditions are equal, the space between the stiffening members 15 and 15 in the face-down paper discharge tray 6 may be set narrower than that between the stiffening members 15 and 15 in the face-up paper discharge tray 5. This is because the stiffening member 15 is a member for stiffening the paper P, the base 18 of the face-down paper discharge tray 6 is inclined with its tip oriented upwardly, and the paper P is discharged obliquely and upwardly, and thus the paper P may be required to be stiffened more strongly for discharge in order to overcome the air resistance.

As shown in FIG. 1, between the second discharge path 16 and the introduction path 7 from the paper feed trays 3 and 4, a switchback path 20 is provided in a diverging manner. This switchback path 20 is means adapted to receive the paper P conveyed through the conveying path 8 and then return it reversely through the conveying path 8, thereby flipping top and bottom surfaces of the paper P on the conveying path 8. Use of this switchback path 20 and passage of the paper P through the conveying path 8 twice by flipping the top and bottom surfaces of the paper P permits color both-sided printing by which a color image is formed on both surfaces of the paper P with the inkjet heads C, K, M, and Y.

Figure 4:
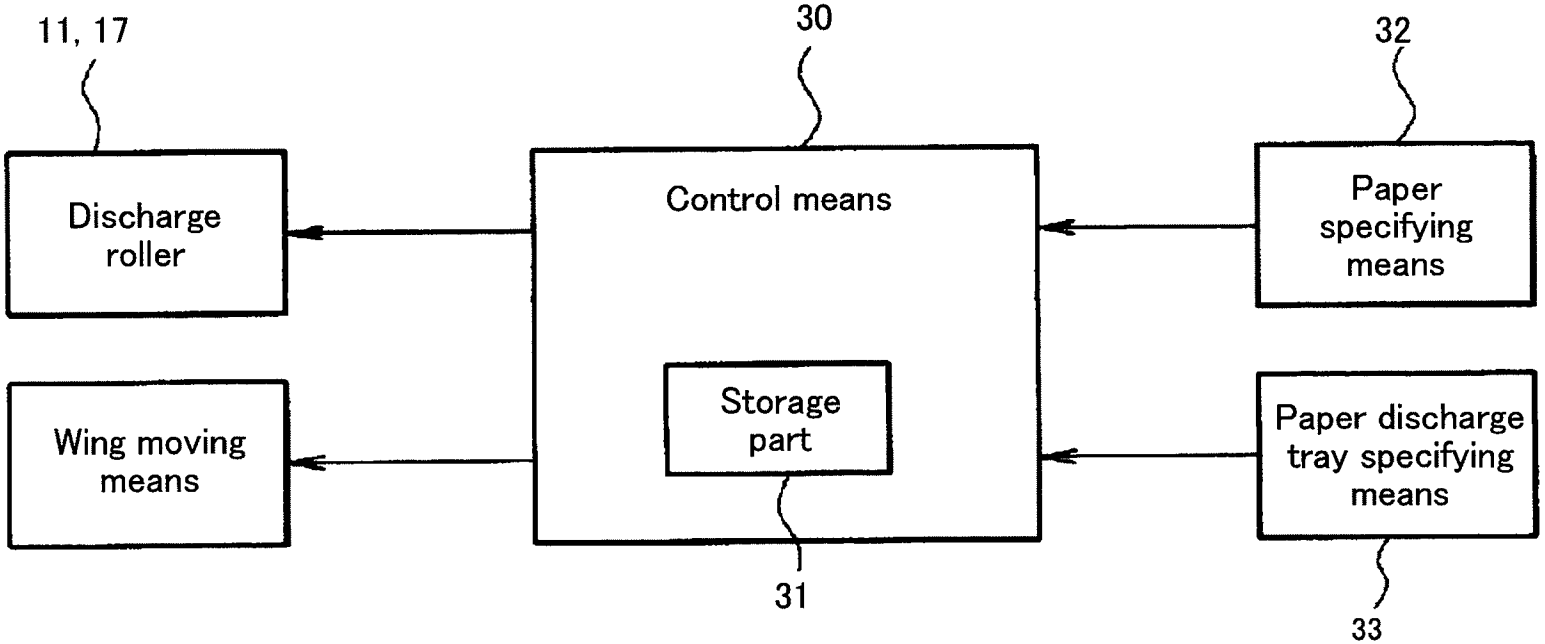
FIG. 4 is a functional block diagram showing control configuration of this embodiment.

Next, referring to a functional block diagram of FIG. 4, functions of discharge speed control and control of setting of the space between the stiffening members 15 in image formation of a first sheet will be described.

The image forming apparatus 1 includes control means 30 that integrally controls functions related to the image formation. This control means 30 includes a storage part 31 that stores various programs and data pieces required for the image formation and also discharge speed and other control data required for discharge speed and other controls of the first sheet of a print, which is a characteristic of the apparatus 1.

The discharge speed and other control data stored in this storage part 31 is primarily data of a discharge speed at which stiffening failure does not occur when the first sheet of the paper P is discharged, in correspondence with a combination of discharge angles of the paper P at the paper discharge trays 5 and 6 (for example, 0 degree for the face-down paper discharge tray 6 and 30 degrees for the face-up discharge tray 5) and a usable paper kind (paper thickness or thinness). Specifically, when the certain paper discharge tray (one the face-up paper discharge trays 5 or 6) (that is, the discharge angle) and the certain paper kind (paper thickness or thinness) have been selected, it can be previously defined by an experiment at what degree of discharge speed orderly paper discharge against the air resistance can be performed; therefore, such data can be previously obtained and it can be stored into the storage part 31 as data in a table format indicating the correspondence between the combination of the discharge angle (or kind of the paper discharge tray) and the paper kind and the discharge angle suitable therefor.

The relationship between the discharge angle and the discharge speed in the discharge speed and other control data will be described. Comparing a case where the discharge angle at which the paper P is discharged in a substantially horizontal direction is 0 degree as is the case of the face-up paper discharge tray 5 with a case where the paper P is discharged at an angle inclined upwardly from the horizontal direction as is the case with the face-down paper discharge tray 6, the latter is more susceptible to resistance by stationary air when the first sheet of the paper P is discharged, thus requiring a faster discharge speed. Therefore, for the data of the storage part 31 described above, if the kind of the paper P is equal, the paper discharge speed is set larger for the case of the face-down paper discharge tray 6 than for the case of the face-up paper discharge tray 5. Moreover, in a case where the discharge angle exceeds 0 degree (case where the paper P is discharged obliquely and upwardly), a faster discharge speed is typically required with an increase in the discharge angle.

In the case where the discharge angle is 0 degree (the face-up paper discharge tray 5 is used), discharge at the set speed as a speed for second and subsequent sheets leads to disturbance of a paper discharge state as a result of bouncing from the striking plate 14; therefore, the first sheet is discharged at a slower speed than that of the second and subsequent sheets and the second and subsequent sheets are discharged at the original speed. At this point, since the discharge speed of the first sheet is slower than that of the second page, control is performed so as to delay paper feed timing of the second and subsequent sheets in order to avoid hitting the first sheet of the paper P by the second and subsequent sheets of the paper P.

Relationship between the paper kind and the discharge speed in the discharge speed and other control data will be described. Comparing plain paper with thin paper, the thin paper typically has smaller hardness than the plain paper; therefore, an even faster discharge speed is required in order to overcome the resistance against the stationary air when the thin paper is discharged as the first sheet of the paper P. Therefore, also for the data of the storage part 31, if the discharge angle is equal, the paper discharge speed is set faster for the thin paper than for the plain paper and a cardboard.

The discharge speed is defined for the combination of the discharge angle and the paper kind, but the discharge speed may be defined for at least one of parameters including the discharge angle and the paper kind.

The discharge speed and other control data stored in the storage part 31 is for setting the discharge speed of the first sheet of the paper P to control the conveying means 9 as described above, but secondarily may include data for controlling the setting of the space between the stiffening members 15 and 15 based on the similar parameters. Specifically, when the certain paper discharge tray (that is, discharge angle) and the certain paper kind (paper thickness or thinness) have been selected, it can be previously defined by an experiment what degree of the space between the stiffening members 15 and 15 permits orderly paper discharge without being blocked by the air resistance; therefore, such data may be previously obtained and this may be stored into the storage part 31 as data in, for example, a table format indicating correspondence between the combination of the discharge angle and the paper kind and the space between the stiffening members 15.

Relationship between the discharge angle in the discharge speed and other control data and the space between the stiffening members 15 and 15 will be described. Comparing the case where the discharge angle at which the paper P is discharged in the substantially horizontal direction as is the case of the face-up paper discharge tray 5 is 0 degree with the case where the paper P is discharged at the angle inclined upwardly from the horizontal direction as is the case of the face-down paper discharge tray 6, the latter is usually more susceptible to the resistance by stationary air when the first sheet of the paper P is discharged; therefore, in order to overcome this resistance, the space between the stiffening members 15 and 15 needs to be narrower to increase the stiffness of the paper P. Therefore, also for the data of the storage part 31, if the kind, the discharge speed, etc. of the paper P are equal, the space between the stiffening members 15 and 15 is set narrower for the case of the face-down paper discharge tray 6 than for the case of the face-up paper discharge tray 5. Moreover, if the discharge angle exceeds 0 degree (if the paper P is discharged obliquely and upwardly), the space between the stiffening members 15 and 15 typically needs to be narrowed down further with an increase in the discharge angle.

Relationship between the paper kind in the discharge speed and other control data and the space between the stiffening members 15 and 15 will be described. Comparing the plain paper with the thin paper, the thin paper usually has weaker hardness than the plain paper; therefore, in a case where the thin paper is discharged as the first sheet of the paper, the space between the stiffening members 15 and 15 needs to be narrowed to increase the stiffness of the paper P in order to overcome the resistance against the stationary air. Therefore, also for the data of the storage part 31, if the discharge angle, the discharge speed, etc. are equal, the space between the stiffening members 15 and 15 is set narrower for the thin paper than for the plain paper and the cardboard.

Here, the discharge speed is defined for the combination of the discharge angle and the paper kind, but the space between the stiffening members 15 and 15 may be defined for at least one of the parameters.

Based on the above description, one example of detailed contents of the discharge speed and other control data according to this embodiment is as follows.

The discharge speed when the plain paper and the face-down paper discharge tray 6 are selected is defined as s standard speed.

When the plain paper and the face-up paper discharge tray 5 are selected, the discharge speed is slower than the standard speed. As described above, this is for avoiding a trouble caused by the bouncing from the striking plate 14.

When the thin paper and the face-down paper discharge tray 6 are selected, the discharge speed is faster than the standard speed. This is for overcoming the air resistance.

When the thin paper and the face-up paper discharge tray 5 are selected, the discharge speed is slower than the standard speed. As described above, this is for avoiding the trouble caused by the bouncing from the striking plate 14.

Further, although this is not included in the embodiment, in a case where a paper discharge tray with an even larger discharge angle is used, if the thin paper is selected, the discharge speed is even faster. If the plain paper is used for this paper discharge tray, there is usually no problem with the standard speed but a speed faster than the standard speed may be adopted when necessary.

As described above, in accordance with the combination of the discharge angle and the paper kind, only the discharge speed may be controlled based on the discharge speed and other data of the storage part 31, or in addition to the discharge speed control described above, more reliable control for the stiffness of the paper P may be simultaneously performed by adjusting the space between the stiffening members 15 and 15 based on the data of the storage part 31.

The control means 30 is provided with: paper specifying means 32 adapted to specify the paper P to be used; and paper discharge tray specifying means 33 adapted to specify the paper discharge tray to be used. These specifying means 32 and 33 may be operation panels provided as input means of the image forming apparatus 1, in which case the user operates the operation panels to thereby perform, as some of various pieces of image formation information, the specification of the paper to be used (selection from the thin paper, the plain paper, the cardboard, etc.) and the specification of the paper discharge tray to be sued (selection from the face-up paper discharge tray 5 and the face-down paper discharge tray 6). Alternatively, in a case where the image formation information is remotely transmitted from an external PC or the like, the external PC serves as means adapted to specify the paper and the paper discharge tray.

When the paper P to be used has been specified by the paper specifying means 32 and the paper discharge tray to be used has been specified by the paper discharge tray specifying means 33, the control means 30 reads from the storage part 31, for the combination of the discharge angle of the specified paper discharge tray and the thickness of the specified paper P, discharge speed data of the first sheet of the paper corresponding to the combination as optimum data for the combination. Then the control means 30 drives the conveying means 9 so that for the first sheet of the paper P from print start, the paper P is discharged at this paper discharge speed. For the second and subsequent sheets of the paper P, discharge is performed at a regular discharge speed slower than the speed of the first sheet.

Figure 5:
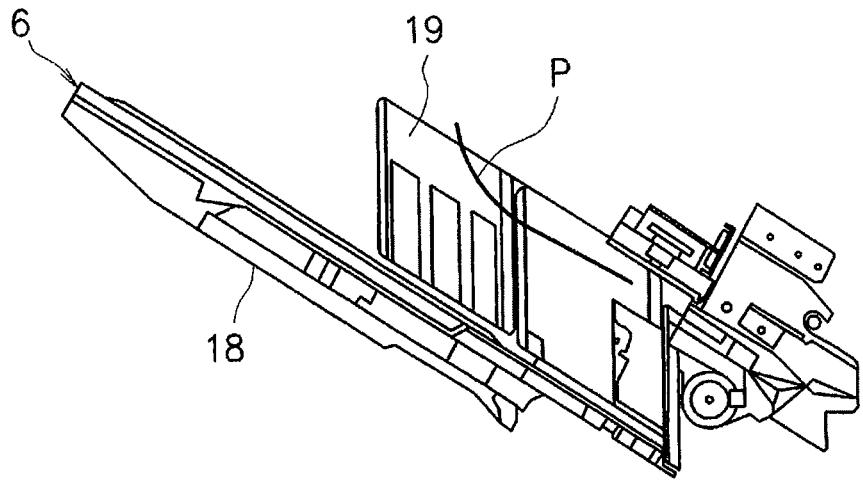
FIG. 5 is a perspective view showing condition that a first sheet of paper is discharged without performing speed control in the face-down paper discharge tray of the image forming apparatus of this embodiment.

When thin paper with weak rigidity is used, assumed is a case where discharge is performed on the face-down paper discharge tray 6 having a larger inclination angle at, for example, the discharge speed for the case of the face-up paper discharge tray 5 (the standard speed in one example described above). In this case, as shown in FIG. 5, at a time point for the first sheet from the print start, the air on the face-down paper discharge tray 6 is stationary and thus no air flow has been provided yet; therefore, the first sheet of the paper P delivered obliquely and upwardly hits a wall of this stationary air and its tip end rises upwards across its full width, resulting in loss of speed. This can be said to be a result of insufficient discharge speed for the thin paper. Then the paper P drops so as to cover the discharge port, causing problems such as deteriorated discharged paper alignment due to occurrence of paper discharge failure such as jam.

Figure 6:
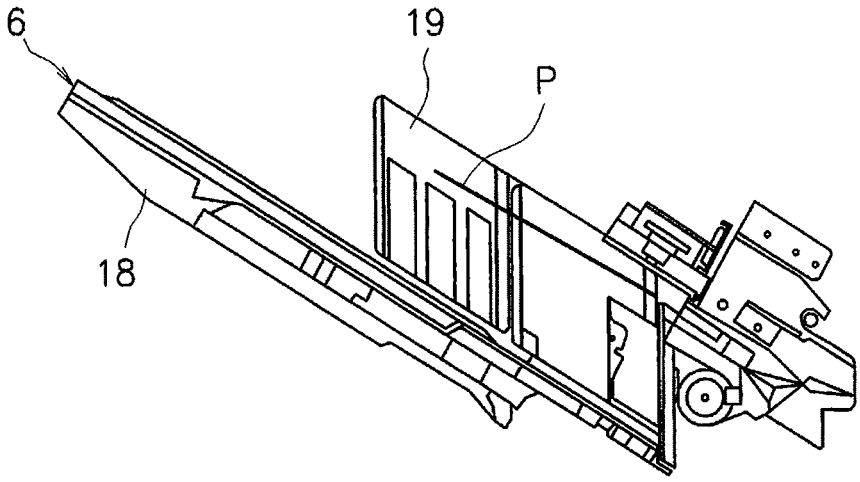
FIG. 6 is a perspective view showing condition that the first sheet of the paper is discharged by performing the speed control in the face-down paper discharge tray of the image forming apparatus of this embodiment.

However, with the image forming apparatus 1 of this embodiment, when the face-down paper discharge tray 6 with a relatively large inclination angle and the thin paper are selected to perform image formation and discharge, the paper discharge is performed at a larger paper discharge speed than the paper discharge speed of the face-up paper discharge tray 5 (the standard speed in one example described above) having a relatively smaller inclination angle. Thus, as shown in FIG. 6, a current state is for the first sheet from the print start where the air on the face-down paper discharge tray 6 is stationary and thus there is no air flow, and even when the thin paper with weak rigidity is used, the paper P jumps with its tip end not deformed and not losing speed and then the paper drops at a predetermined position on the face-down paper discharge tray 6 by force of gravity. Then for the second and subsequent sheets of the paper P, air flow has already been provided as a result of the paper discharge, discharge can be performed at a smaller discharge speed than that of the first sheet without any problem, so that the paper P is accumulated through favorable alignment on the face-down paper discharge tray 6 in sequence.

The above description refers to a case where the discharge speed is controlled. Aside from this control or in addition to this control, the space between the stiffening members 15 and 15 may be controlled based on the same parameters. That is, when the paper P to be used has been specified by the paper specifying means 32 and the paper discharge tray to be used has been specified by the paper discharge tray specifying means 33, the control means 30 reads from the storage part 31, for the combination of the discharge speed of the specified paper discharge tray and the thickness of the specified paper P, data on the space between the stiffening members 15 and 15 corresponding to this combination as optimum data for this combination. Then the control means 30, for the first sheet of the paper P, controls the wing moving means to set the space between the stiffening members 15 of the specified paper discharge tray at a space in accordance with the data and perform discharge of the paper P. For the second and subsequent sheets of the paper P, the space between the stiffening members 15 and 15 is set at a normal space longer than that of the first sheet and discharge of the paper P is performed.

As described above, with the image forming apparatus 1 of this embodiment, even with the thin paper P with weak rigidity in particular, or even in a case where resistance received by the paper P from the air increases due to a large discharge angle, the discharge speed of the paper P or the space between the stiffening members 15 and 15 is appropriately controlled from the first sheet after the print start in particular; therefore, deformation such as rising of the tip end part hardly occurs on the discharged paper P, which permits orderly alignment and loading starting with the first sheet after the print start without causing, for example, the paper discharge failure.

Especially, with the image forming apparatus 1 of this embodiment, a method of controlling the discharge speed of the paper P in correspondence with at least one of the parameters including the discharge angle of the paper P and the kind of the paper P and also a method of controlling the space between the stiffening members 15 and 15 in correspondence with the same parameter can automatically be performed based on the prepared data of the storage part 31; therefore, for various combinations of a plurality of paper kinds and a plurality of paper discharge trays, an elaborate operation of orderly alignment and loading on the paper discharge tray starting with the first sheet of a print can easily be performed by anyone without relying on experience.

In the embodiment described above, the number of paper discharge trays with different discharge angles is two, but this number may be three. Moreover, in a case where a paper discharge tray whose discharge angle is variable when necessary is adopted, if this paper discharge tray is selected, the discharge speed and the space between the stiffening members 15 can be controlled in accordance with, for example, the discharge angle set at this paper discharge tray.

REFERENCE SIGNS LIST

1 Image forming apparatus
5 Face-up paper discharge tray
6 Face-down paper discharge tray
9 Conveying means
11 Discharge rollers as conveying means
17 Discharge rollers as conveying means
30 Control means
31 Storage part
32 Paper specifying means
33 Paper discharge tray specifying means
P Paper
C, K, M, Y Inkjet head as image forming means

CITATION LIST

Patent Literature 1

Japanese Patent Application Laid-open No. 2010-143728

The invention claimed is:

1. An image forming apparatus comprising:
a conveying device configured to convey paper;
an image forming unit configured to form an image on the paper; and
a paper discharge tray where the image-formed paper is discharged and loaded at a predetermined discharge angle by the conveying device,
wherein the conveying device is controlled in a manner that a discharge speed of a first sheet of the paper discharged on the paper discharge tray having no air flow therearound and susceptible to air resistance is different from a discharge speed of a second or subsequent sheet of the paper discharged on the paper discharge tray having air flow generated by the first or a previous sheet of the paper and less susceptible to the air resistance than the first or the previous sheet of the paper in accordance with at least one of the discharge angle and a kind of paper to be used.

2. The image forming apparatus according to claim 1, wherein the conveying device is controlled in a manner that the discharge speed of the first sheet of the paper becomes faster than the discharge speed of the second or subsequent sheet of the paper with an increase in the discharge angle and/or a decrease in a paper thickness for the paper kind.

3. The image forming apparatus according to claim 2, further comprising:
a plurality of kinds of the paper discharge tray with different discharge angles;
a storage part configured to store, for each of the paper discharge trays, correspondence between a combination of the discharge angle and the paper thickness and the discharge speed of the paper;
a paper specifying device configured to specify paper to be used;
a paper discharge tray specifying device configured to specify the paper discharge tray to be used; and
a control unit configured to control the conveying device by reading, from the storage part, the discharge speed corresponding to the combination of the paper specified by the paper specifying device and the paper discharge tray specified by the paper discharge tray specifying device.

4. The image forming apparatus according to claim 1, wherein the conveying device is controlled in a manner that the discharge speed of the first sheet of the paper becomes faster than the discharge speed of the second or subsequent sheet of the paper with an increase in the discharge angle when the paper is discharged at an angle inclined upwardly from a horizontal direction.

5. The image forming apparatus according to claim 1, wherein the conveying device is controlled in a manner that the discharge speed of the first sheet of the paper becomes slower than the discharge speed of the second or subsequent sheet of the paper when the paper is discharged in a horizontal direction.

6. The image forming apparatus according to claim 1, wherein the conveying device is controlled in a manner that the discharge speed of the first sheet of the paper becomes faster than the discharge speed of the second or subsequent sheet of the paper with a decrease in a paper thickness for the paper kind.

7. The image forming apparatus according to claim 1, wherein the paper discharge tray includes on both sides thereof a pair of stiffening members respectively making contact with both edge parts of the discharged paper in a width direction and stiffening the paper, the stiffening members being capable of adjusting a space between the pair of stiffening members.

8. The image forming apparatus according to claim 1, further comprising a paper specifying device configured to specify paper to be used, wherein the discharge speed of the first sheet of the paper specified by the paper specifying device is faster than the discharge speed of the second or subsequent sheet of the paper specified by the paper specifying device.

9. An image forming apparatus, comprising:

a conveying device configured to convey paper;

an image forming unit configured to form an image on the paper; and a paper discharge tray where the image-formed paper is discharged and loaded at a predetermined discharge angle by the conveying device, wherein the conveying device is controlled in a manner that a discharge speed of a first sheet of the paper discharged on the paper discharge tray having no air flow therearound and susceptible to air resistance is different from a discharge speed of a second or subsequent sheet of the paper discharged on the paper discharge tray having air flow generated by the first or a previous sheet of the paper and less susceptible to the air resistance than the first or the previous sheet of the paper in accordance with at least one of the discharge angle and a kind of paper to be used, wherein the paper discharge tray includes on both sides thereof a pair of stiffening members respectively making contact with both edge parts of the discharged paper in a width direction and stiffening the paper, the stiffening members being capable of adjusting a space, and in order to control paper stiffness by the stiffening members in accordance with at least one of the discharge angle and the kind of the paper to be used, the space between the pair of stiffening members when the first sheet of the paper makes contact is narrowed more than a case where the second and subsequent sheets of the paper make contact with an increase in the discharge angle and a decrease in a paper thickness for the paper kind.

10. The image forming apparatus according to claim 9, further comprising a control unit configured to store correspondence between a combination of the discharge angle and the paper thickness and the discharge speed of the paper, and to control the space between the pair of stiffening members according to the discharge angle and the paper thickness.

11. The image forming apparatus according to claim 9, further comprising a paper specifying device configured to specify paper to be used, wherein the discharge speed of the first sheet of the paper specified by the paper specifying device is faster than the discharge speed of the second or subsequent sheet of the paper specified by the paper specifying device.

12. An image forming apparatus, comprising:

a conveying device configured to convey paper;

an image forming unit configured to form an image on the paper; and a paper discharge tray where the image-formed paper is discharged and loaded at a predetermined discharge angle by the conveying device, wherein the conveying device is controlled in a manner that a discharge speed of a first sheet of the paper discharged on the paper discharge tray having no air flow therearound and susceptible to air resistance is different from a discharge speed of a second or subsequent sheet of the paper discharged on the paper discharge tray having air flow generated by the first or a previous sheet of the paper and less susceptible to the air resistance than the first or the previous sheet of the paper.

13. The image forming apparatus according to claim 12, wherein the paper discharge tray includes on both sides thereof a pair of stiffening members respectively making contact with both edge parts of the discharged paper in a width direction and stiffening the paper, the stiffening members being capable of adjusting a space.

14. The image forming apparatus according to claim 12, further comprising a paper specifying device configured to specify paper to be used, wherein the discharge speed of the first sheet of the paper specified by the paper specifying device is faster than the discharge speed of the second or subsequent sheet of the paper specified by the paper specifying device.

* * * * *